United States Patent [19]

Schreyer

[11] 4,109,982

[45] Aug. 29, 1978

[54] FOLDERS/DIVIDERS AND COMPARTMENTED FILING SYSTEM

[76] Inventor: Kenneth D. Schreyer, 5130 Brookhaven Dr., Clarence, N.Y. 14031

[21] Appl. No.: 747,499

[22] Filed: Dec. 6, 1976

[51] Int. Cl.[2] ..... B42F 15/00; A47B 63/00

[52] U.S. Cl. ..... 312/183; 312/184; 211/51

[58] Field of Search ..... 312/184, 183; 402/4, 402/38; 211/51

[56] References Cited

U.S. PATENT DOCUMENTS

| | | | |
|---|---|---|---|
| 2,103,695 | 12/1937 | Rosen | 211/51 |
| 2,582,058 | 1/1952 | Nabholz | 211/51 |
| 2,910,069 | 10/1959 | Sewell | 211/51 |
| 2,962,335 | 11/1960 | Benson | 312/184 |
| 3,238,947 | 3/1966 | Churnick | 312/184 |
| 3,540,786 | 11/1970 | Potter | 312/184 |
| 3,696,926 | 10/1972 | Syversen | 312/183 |
| 3,814,490 | 6/1974 | Dean et al. | 312/183 |
| 3,863,828 | 2/1975 | King | 312/184 |
| 4,005,797 | 2/1977 | Ingram | 312/183 |

FOREIGN PATENT DOCUMENTS

| | | | |
|---|---|---|---|
| 1,084,713 | 1/1955 | France | 312/184 |
| 1,293,428 | 12/1962 | France | 312/184 |
| 450,765 | 8/1949 | Italy | 312/184 |
| 810,194 | 3/1959 | United Kingdom | 312/184 |

*Primary Examiner*—Kenneth Downey
*Assistant Examiner*—Victor N. Sakran

[57] ABSTRACT

Correspondence (or the like) filing folders and filing cabinet drawer dividers, hereinafter generally referred to as "separators", are made of relatively thin and inexpensive sheet material and are novelly constructed and configured to prevent them from "slumping" when installed in a compartmented filing system; the folders/-dividers being of improved functioning and increased life characteristics. An improved (optionally employed) file content "follower" contributes to an overall improved filing system.

14 Claims, 18 Drawing Figures

Fig. 1.
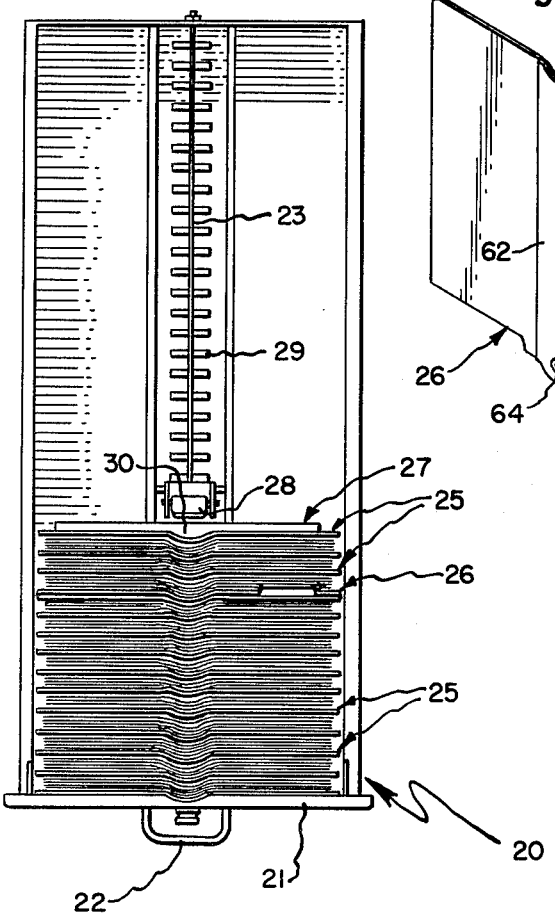
Fig. 3.
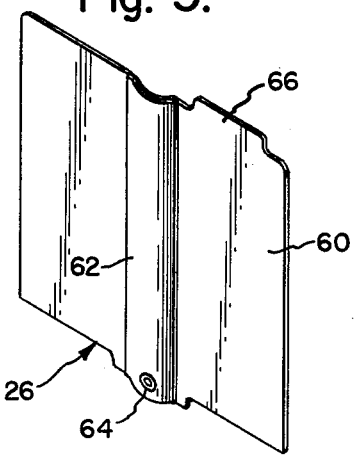
Fig. 2.
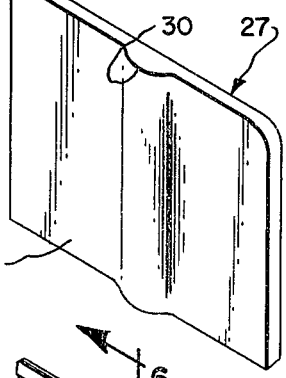
Fig. 4.
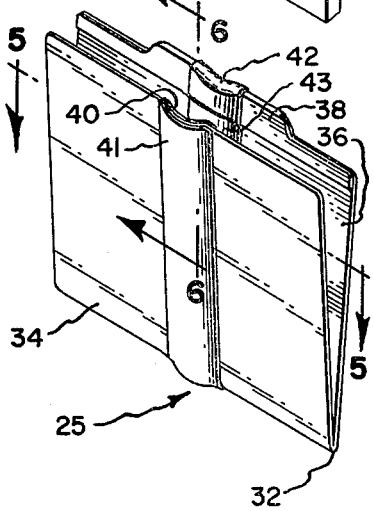
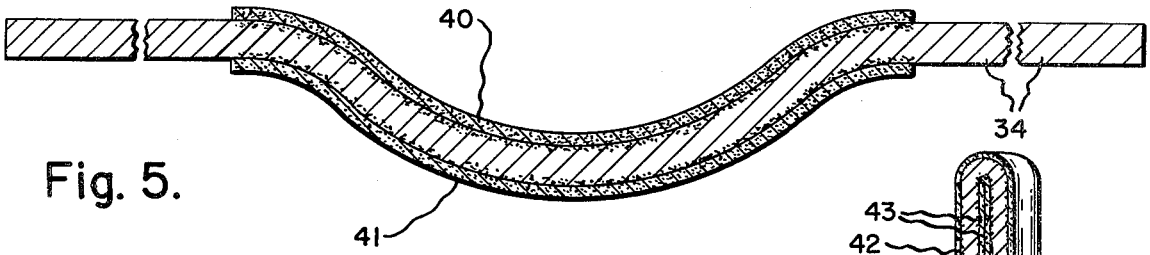
Fig. 5.
Fig. 6.
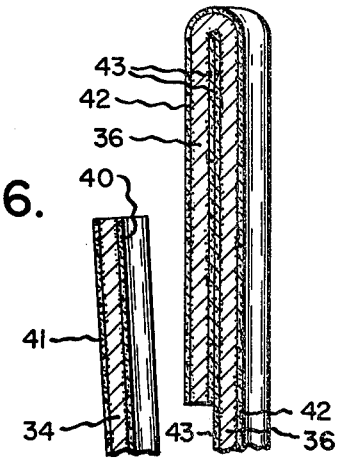

Fig. 7.
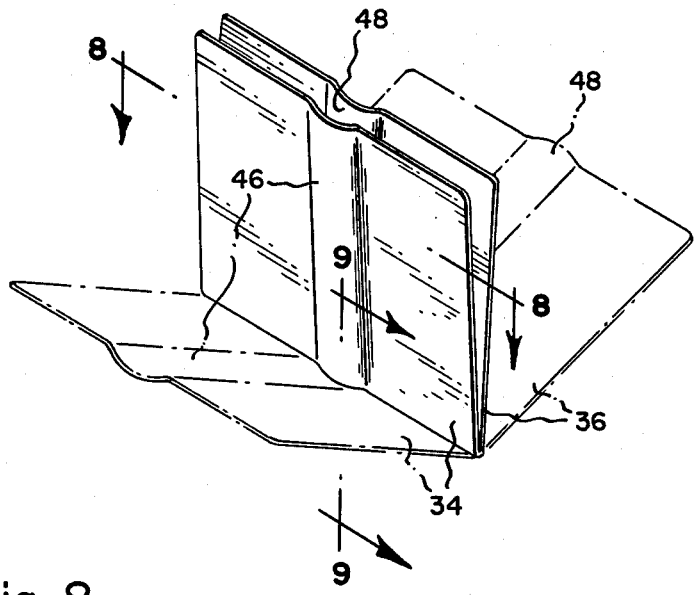
Fig. 9.
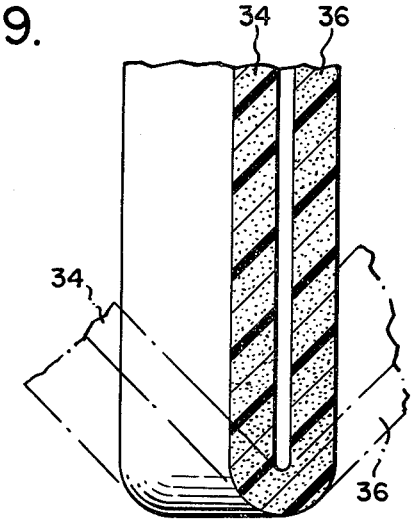
Fig. 8.
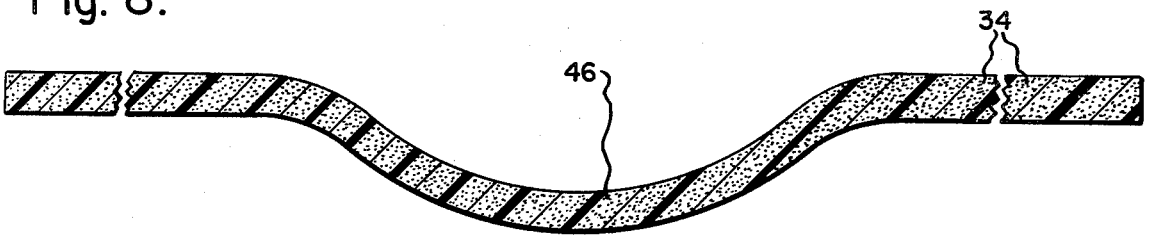
Fig. 10.
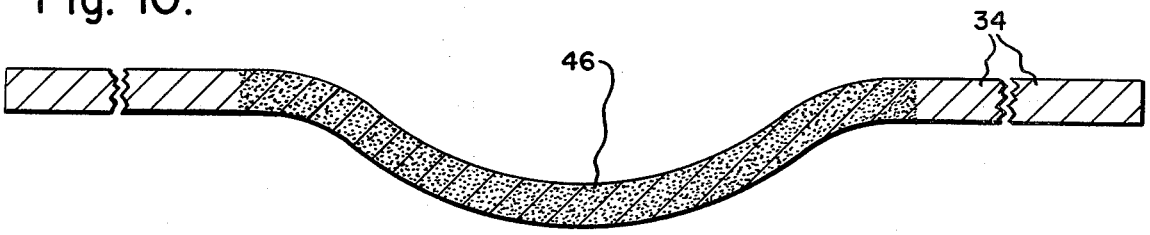
Fig. 11.
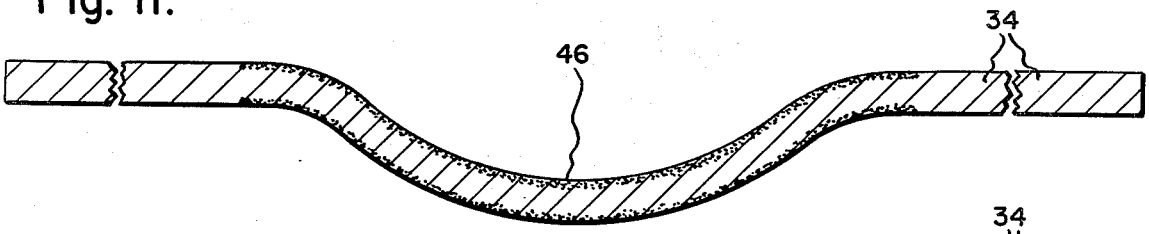
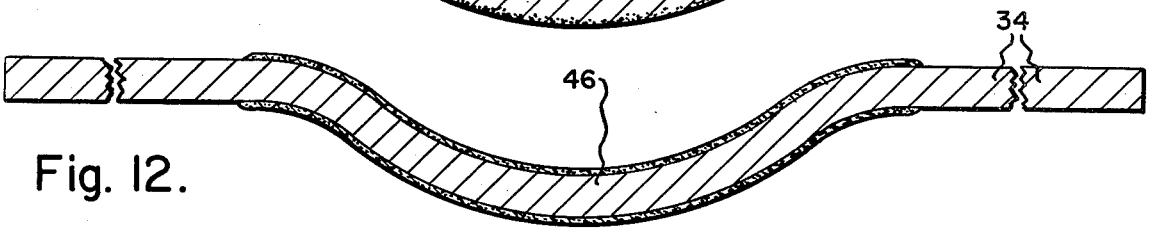
Fig. 12.

Fig. 13.
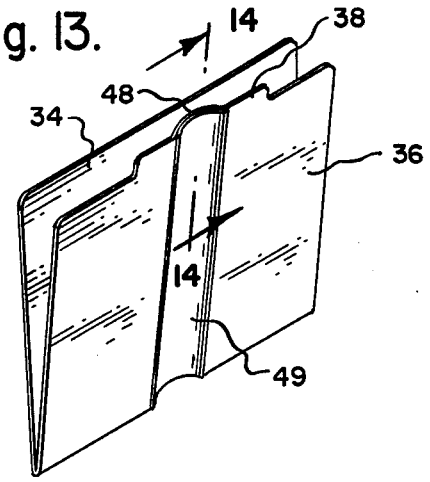
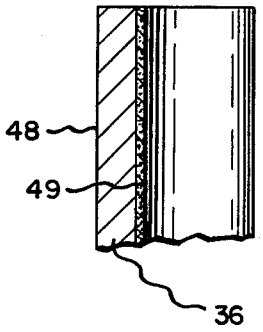
Fig. 14.
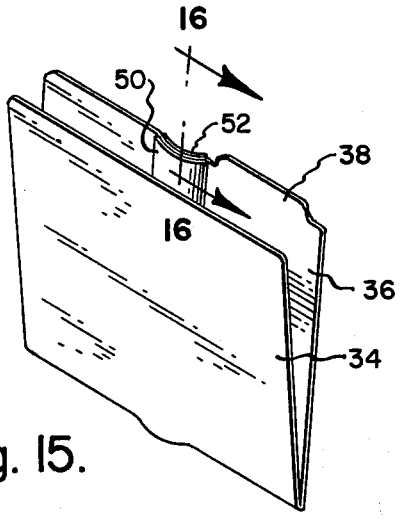
Fig. 15.
Fig. 17.
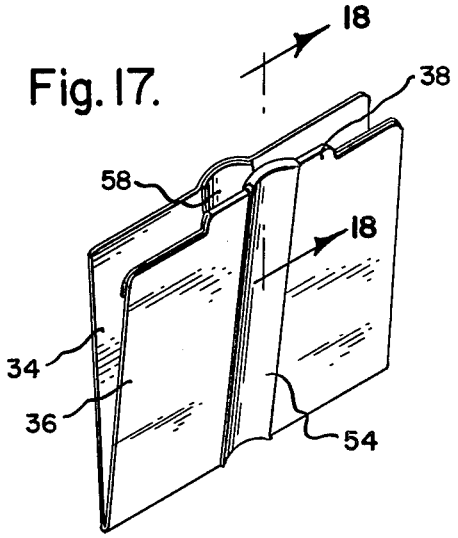
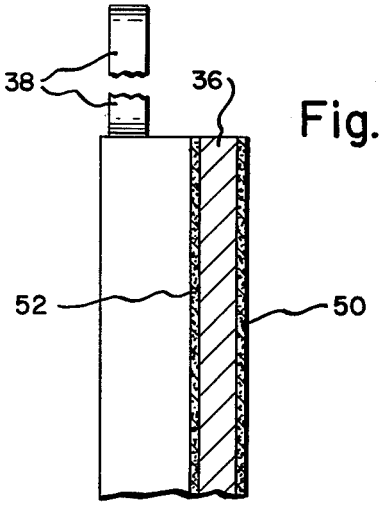
Fig. 16.
Fig. 18.
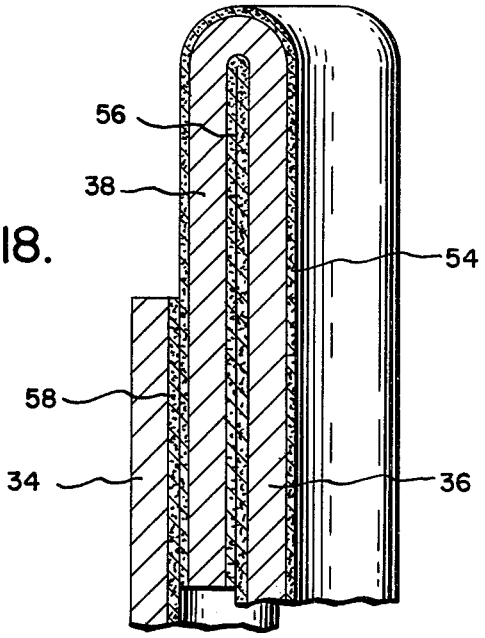

FOLDERS/DIVIDERS AND COMPARTMENTED FILING SYSTEM

BACKGROUND AND OBJECTS OF THE INVENTION

The invention relates to the art referred to in my copending application Ser. No. 573,093 titled "File Folders and Dividers".

As in the case of my above referenced prior application, this invention relates to filing material folders and dividers such as are used for example in conjunction with typical office filing cabinet drawers, shelves, and the like. However, this invention also provides an improved configuration of relatively compartmented filing folders, such as when compacted in a filing cabinet drawer, or the like. It is to be understood that the term "separators" herein refers to devices such as are employed to set apart variously indexed and/or otherwise segregated correspondence, literature, and the like.

As illustrated and described in detail herein, the improved file folders and dividers of this invention generally resemble conventional type file folders and dividers but are novelly configured and vertically stiffened whereby they may be made of relatively thin and inexpensive sheet materials while possessing improved functioning capabilities, and longer useful life. Also, they facilitate individual identifications of the contents of a filing drawer or the like, and separate removals therefrom, as and when desired.

Other objects and advantages of my invention will be understood from the following description of several exemplary embodiments thereof, such as are illustrated in the accompanying drawing, wherein:

THE DRAWING

FIG. 1 is a top plan view of a filing cabinet drawer, including a so-called compressor (or follower) and dividers, and a plurality of letter carrying type folders of the invention disposed therein;

FIGS. 2, 3 and 4 are perspective views of a preferred form of follower; and a divider; and a filing folder, respectively; of the types such as are shown in FIG. 1;

FIGS. 5–6 are fragmentary enlarged scale sectional views taken as shown on FIG. 4;

FIG. 7 is a perspective view of a modified form of the folder, showing a typical form of folder of the present invention in open position by means of phantom lines;

FIGS. 8–9 are enlarged scale fragmentary sectional views, taken as shown in FIG. 7;

FIG. 10 is a view corresponding to FIG. 8, showing another form of the folder construction;

FIG. 11 is a view corresponding to FIGS. 8–10, showing still another form of the folder construction;

FIG. 12 is a view corresponding to FIGS. 8–11, showing still another form of the folder construction;

FIG. 13 shows still another form of the folder construction;

FIG. 14 is an enlarged scale fragmentary sectional view taken on line 14—14 of FIG. 13;

FIG. 15 shows still another form of the folder of the invention;

FIG. 16 is an enlarged scale fragmentary section taken on line 16—16 of FIG. 15;

FIG. 17 shows still another form of folder of the invention; and

FIG. 18 is an enlarged scale fragmentary sectional view taken as shown in FIG. 17.

As shown at FIGS. 1–4, a feature of this invention relates to a novel system for compartmenting office filing folders within conventional type correspondence filing cabinet drawers. For example, as shown at FIG. 1, the drawer is designated generally by the numeral 20 and is of open top rectangular boxlike form having a front panel 21 carrying a push-pull handle 22. A conventional type divider hold-down rod is illustrated at 23, and a plurality of correspondence filing folders 25 of the present invention are shown as being vertically disposed within the drawer and separated by dividers as shown at 26. The folders are compacted therein between the front panel 21 and a "compressor" or "follower" 27. The follower 27 comprises a rigid back plate portion which is carried by a manually operable shoe and latching device 28 which engages a track 29 in the bottom of the drawer so that the compressor may be positionally adjusted manually along the track so as to provide suitable back-up support for the folders disposed within the drawer. Such general arrangements are of course standard practice in the art and form no part of the present invention, except that in the case of the present invention the compressor panel 27 is preferably provided with a vertically running and forwardly extending parti-cylindrical ridge-like formation 30 (FIG. 2) for reasons to be more fully explained hereinafter.

As shown by way of example at FIGS. 1, 4, 5, 6, the file folders 25 of this invention may be made of relatively thin and inexpensive paper stock, folded as indicated at 32 (FIG. 4) thus providing a front panel portion 34 and a rear panel portion 36 so as to provide a suitable pocket into which correspondence material or the like may be readily slip-fitted, as in conventional filing practice. Instead of a sharp fold as shown at 32 in FIG. 4, the bottom portion of the folder may be alternatively box folded or pleated, or the like if preferred, in order to permit each folder to accommodate increased volumes of correspondence, as is also known in the art. Also, the upper edge of the rear panel (and or the front panel) may be reinforced by reverse folding it, and/or the rear panel may be otherwise provided with an upstanding identification or "index tab" portion 38.

Thus, in accordance with this example of the present invention as shown specifically at FIGS. 4–6, incidental to blanking out the paper sheet material which is to be formed into the folder 25, strips 40, 41 and 42, 43 of relatively soft paper, plastic, or the like are supplied to opposite sides of both the front and rear panel portions of the folder to be fabricated, while the latter is still in flat unfolded form. The strips 40–43 may be applied and adhered thereto by use of any suitable cement or adhesive or the like such as may be selected from naturally adhesive type materials or are of the synthetic type adhesives. Or, they may be of solvent/heat/pressure "sensitive" type material, such as may be bonded to the basic stock, to resiliently maintain the corrugated configuration. They may be either time-settable or heat-settable or chemically-settable. To simplify this specification, such materials will be referred to hereinafter simply as "adhesives".

As best illustrated at FIG. 4, the strips 40–43 are applied to run vertically of the front and rear panel portions of the folder substantially centrally thereof. Subsequent to applications of the strips 40–43 to the folder sheet stock material at opposite sides thereof, the sheet is rolled or pressed into corrugated form in the regions of the strip applications. If necessary the rolling or pressing operation may be accompanied by application of heat in order to cause the adhesive material incorporated within the fabrication to accelerate into its resiliently "set" corrugated form as illustrated at FIGS. 1,4,5.

The sheet is subsequently folded at the junction of the front and rear panel portions as explained hereinabove; or, alternately the sheet may first be folded over and then pressed into corrugated form in order to provide the finished folder in the configuration as shown at FIG. 4. As explained, the nature of the "adhesive" employed in this operation will determine the need for use of heat or other catalyst incidental to the process. In any case the purpose is to provide the otherwise relatively limp front and rear panel portions of the finished folder with certain vertical stiffness characteristics, and the "adhesive", when set as explained hereinabove, will operate to provide the corrugated sections of the finished folder with the desired degree of resilient stiffness.

Inasmuch as both the front and rear panel portions of the folder are locally reinforced in this manner, they remain resiliently stiff when the folder is hingedly opened as best illustrated at FIG. 7. This facilitates convenient handling of the folder as well as also insuring that the front and rear panel portions maintain the desired upstanding stiffness when they are occupied by filing material, as compared to conventional type folders which tend to slump down in the filing cabinet drawer so that the index tab portions become obscured, rendering difficult individual identification and/or removal of the folders from the drawer. Note also that because the contents of the folder, such as correspondence papers or the like, assume the same centrally corrugated form as the folder, the contents per se of the folder temporarily or semi permanently acquire improved vertical stiffness, thereby cooperating to resist "slumping" of the file.

Note that as shown in FIG. 4 the reinforcing strips 42–43 may be applied to the rear panel of the folder to extend upwardly and throughout the vertical extent of the folder index tab portion 38; thereby further reinforcing that portion of the folder against typical folder usage hazards. By so shaping the top plan view configuration of the index tab portion of each folder as shown at FIG. 1, the "fingering" portions of the folders are of improved stiffness and durability and separation of adjacent folders is facilitated for exposing the folder identification labels. Also, the contents of the folders are more fully exposed by reason of the resilient stiffness of the front and rear panels of the folder. As shown at FIG. 7, the folders inherently tend to open into a V-shaped configuration. Thus, it will be appreciated that this provides an additional convenience for the user of the filing system in respect to separately identifying and or removing from the drawer a sought-for file folder.

FIGS. 7, 8, 9, illustrate another form of folder of the invention wherein the folder is fabricated of either a plastic sheet material or of a paper stock sheet which is impregnated with some heat or otherwise settable material. In such case, after the sheet is blanked out from the stock piece it is pressed or rolled into the centrally corrugated form as illustrated and referred to herein, and then maintained in that configuration until the front and rear panel portions become resiliently "set". The sheet is then folded across the bottom section thereof to provide the finished folder as best shown in FIG. 7, which also illustrates how the front and rear panels of the folder are thus adapted to maintain their resilient stiffness, whether the folder is in its closed or in its open condition.

FIG. 10 corresponds to FIG. 8 but illustrates how the heat-settable material which is impregnated into the paper stock material may be localized so as to exist mainly in the region of the corrugations which are to be formed in the sheet stock, as explained hereinabove. FIG. 11 corresponds to FIGS. 8 and 10 but illustrates how the heat or otherwise settable material may be impregnated only into the outer surface portions of the paper stock piece, FIG. 12 illustrates how the paper stock may be simply coated at both sides thereof with some suitable plastic material such as may be "set" as explained hereinabove in the regions of the corrugations to be formed therein.

FIGS. 13 and 14 illustrate how only the rear panel portion of the folder, including the index tab portion, may be resiliently stiffened in corrugated form by application thereto of a relatively soft paper strip 49 impregnated with a suitable "adhesive". FIGS. 15 and 16 illustrate how both surfaces of the rear panel may be resiliently stiffened by adhesively applied paper strips 50, 52, in the manner explained hereinabove; and FIGS. 17 and 18 illustrate how the rear panel and index tab portion thereof may be both fabricated into the desired resiliently stiffened corrugated form by application thereto of adhesive-coated paper strips 54, 56 and then pressed into corrugated form until resiliently set, as explained hereinabove. Also, as shown in FIGS. 17, 18, a third paper strip 58 may be adhesively applied if desired to one side of the front panel 34 in the corrugated section thereof. As another modification of the invention, the stock piece from which the folders are made may comprise a sheet of paper coated on one or both of its sides with a plastic material in film or layer form.

FIG. 2 illustrates a preferred form of "compressor" or "follower" for use in connection with the storing of filing folders of the present invention in a filing drawer, or the like. As explained hereinabove, the follower 27 comprises essentially a rigid upstanding back plate 28, the front surface of which is provided with a vertically running parti-cylindrical protuberance 30 which is configured to substantially complement and interfit with the corrugated sections of the folers, as illustrated at FIG. 1. Thus, the follower 27 is adapted to function as a compressor against a batch of loaded file folders; the protuberance 30 of the follower cooperating to assist in maintaining the naturally assumed corrugated configurations of the file folders, whereby to maximize the advantages of the filing system of the present invention as heretofore explained. Similarly the front panel portion 21 of the drawer may preferably be shaped as shown at FIG. 1 to complement the centrally corrugated form of the folders.

As illustrated at FIG. 3, dividers 26 may be provided for intermediate locations between file folders, as is also illustrated at FIG. 1; and in accordance with this invention the dividers 26 comprise relatively stiff upstanding panels 60 which may be formed of any suitable material such as is adapted to be pressed and set into corrugated form as illustrated at 62, so as to also complement the corrugated configurations of the file folders 25. The divider 26 is also shown as having an apertured lower tab portion 64 through which the hold-down rod 23 slip-fits; and may also be furnished with an identification tab portion 66, as is of course known in the art.

It is a particular feature of the present invention that the vertical stiffness concept hereof obviates the need heretofore encountered to align the "grain" of paper stock in such direction (during the "blanking out" process) that the "grain" in the finished folder will extend and stiffen the folder panels vertically. In the case of the present invention it may be arranged so that the grain of the paper stock extends transversely of the vertically extending parts of the folder (or divider). This not only simplifies the manufacturing process (because of the fact that conventionally supplied paper stock rolls inherently orient the grain of the paper transversely of the roll) but also provides for an improved economy of paper stock usage, and also permits the use of wider space stock rolls, thereby calling for less frequent roll change-overs.

In the case of the present invention the folders may be blanked out from the paper stock transversely of the paper web, thereby incorporating in the finished folder a desirable degree of horizontal resilient stiffness inherent with the direction of the paper "grain". This, when augmented by the vertically directed resilient stiffness characteristics provided by the corrugated configuration as explained hereinabove, furnishes an overall improved folder construction. Conventionally, when working with paper stock folding processes are made across the web in order to simplify the manufacturing process. However, in the case of the present invention the folds required to be made in the paper stock may be in directions parallel to the paper web. Therefore, such folders can be fabricated by continuously running cam-sliding-folding and rotary trimming and cut-off tools, such as are well known in the paper processing industry. Hence, the manufacturing process may be conducted more rapidly and at reduced cost compared to processes requiring intermittent stock feeding and processing operations.

I claim:

1. A separator intended to rest on its vertically lower edge, for keeping classified correspondence, literature and the like segregated when installed vertically in a filing cabinet or the like, said separator including:

a vertically standing panel portion formed of characteristically thin and limp stock sheet material and having vertically extending means extending over substantially the entire vertical extent of said separator and integral therewith for deforming at least one widthwise section thereof into a permanent, resiliently set, vertically extending, corrugated configuration, whereby said separator is provided with inherent resilient stiffness in the vertical direction so as to resist downward slumping and so as to maintain an upright standing condition, wherein said separator comprises a filing folder fabricated of initially flat sheet material said folder having a front and rear panel portion integrally interconnected hingedly across the bottom of the folder in a straight line fold, and wherein at least one of said panel portions is pressed into a resiliently set vertically corrugated configuration.

2. A separator as set forth in claim 10, wherein said separator is fabricated of initially flat sheet material which is impregnated with a resiliently settable substance and subsequently pressed and set into said vertically corrugated configuration.

3. A filing separator as set forth in claim 1, wherein said means for deforming includes a supplemental strip carrying a resiliently settable adhesive substance applied to the region of the intended corrugated configuration thereof and subsequently pressed into the desired configuration, whereby said adhesive substance penetrates said sheet material and resiliently sets in the desired configuration.

4. A separator as set forth in claim 1, wherein said separator is fabricated from initially flat sheet material and said means for deforming includes a film of resiliently settable material applied to at least one side of said sheet material in the area of the desired corrugated configuration.

5. A separator as set forth in claim 1, wherein both of said panel portions are pressed into complementary shaped resiliently set vertically corrugated configurations.

6. A separator as set forth in claim 1, wherein said separator is fabricated from an initially flat paper sheet stock material.

7. A separator as set forth in claim 1, wherein said separator is fabricated from an initially flat plastic sheet stock material.

8. A separator as set forth in claim 6, wherein said means for deforming includes a film of resiliently settable adhesive material applied to at least one side thereof.

9. A separator as set forth in claim 6, wherein the grain of the paper stock is directed transversely of the corrugated configuration of said panel portion.

10. The separator as set forth in claim 5 wherein said sheet material includes paper stock.

11. The separator as set forth in claim 10 wherein said means for deforming includes a supplemental strip carrying a resiliently settable adhesive applied to the region of the intended corrugation and extending continuously from the top of said front panel, across the hingedly interconnected bottom transversely of said straight line fold, and to the top of said rear panel.

12. The separator as set forth in claim 11 wherein said supplemental strip includes a strip of paper.

13. The separator as set forth in claim 11 wherein said supplemental strip includes a strip of plastic.

14. The separator as set forth in claim 11 wherein the grain of the paper stock is directed transversely of the corrugated configuration of said panel portion.

* * * * *

UNITED STATES PATENT AND TRADEMARK OFFICE

CERTIFICATE OF CORRECTION

PATENT NO. : 4,109,982
DATED : August 29, 1978
INVENTOR(S) : Kenneth D. Schreyer It is certified that error appears in the above-identified patent and that said Letters Patent are hereby corrected as shown below:

Column 6, line 4, "claim 10" should be --claim 1--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*